US007837274B2

(12) United States Patent
Abdoli-Eramaki

(10) Patent No.: US 7,837,274 B2
(45) Date of Patent: Nov. 23, 2010

(54) DYNAMIC TRUNK SUPPORT SYSTEM

(75) Inventor: Mohammad Abdoli-Eramaki, North York (CA)

(73) Assignee: Ryerson University, Toronto, Ontario (CA)

( * ) Notice: Subject to any disclaimer, the term of this patent is extended or adjusted under 35 U.S.C. 154(b) by 116 days.

(21) Appl. No.: 12/222,013

(22) Filed: Jul. 31, 2008

(65) Prior Publication Data

US 2010/0026078 A1 Feb. 4, 2010

(51) Int. Cl.
*A47B 97/00* (2006.01)

(52) U.S. Cl. ..... 297/463.2

(58) Field of Classification Search ..... 297/392, 297/393, 404, 405, 411.1, 463.2, 464; 248/118.1, 248/118.3

See application file for complete search history.

(56) References Cited

U.S. PATENT DOCUMENTS 2,667,913 A * 2/1954 Dustin ..... 297/411.1
3,216,767 A * 11/1965 Lutfy ..... 297/391
4,458,784 A * 7/1984 Holmes, Jr. ..... 182/230
4,565,409 A * 1/1986 Hollonbeck et al. ..... 297/411.1
4,715,592 A * 12/1987 Lewis ..... 5/602
4,915,373 A * 4/1990 Walker ..... 482/51
5,730,688 A * 3/1998 Prusick ..... 482/130
6,089,515 A * 7/2000 McGlew ..... 248/118
6,146,317 A * 11/2000 Prusick ..... 482/130
6,148,448 A * 11/2000 Urso ..... 4/254
7,172,539 B1 * 2/2007 Bythewood et al. ..... 482/140

OTHER PUBLICATIONS

A. Aaras, et al., "Postural angles as an indicator of postural load and muscular injury in occupational work situations", *Ergonomics*, 1988, vol. 31, No. 6, 915-933.

M. Abdoli-E, et al., "The effect of on-bodylift assistive device on the lumbar 3D dynamic moments and EMG during asymmetric freestyle lifting", *Clinical Biomechanics* 23 (2008) 372-380.

I. Takahashi, et al., "Mechanical Load of the Lumbar Spine During Forward Bending Motion of the Trunk—A Biomechanical Study", *SPINE* vol. 31, No. 1, pp. 18-23, 2006.

F. Tissot, et al., "Standing, sitting and associated working conditions in the Quebec population in 1998", *Ergonomics*, vol. 48, No. 3, Feb. 22, 2005, 249-269.

A. Godwin, et al., "Testing the efficacy of an ergonomic lifting aid at diminishing muscular fatigue in women over a prolonged period of lifting", *International Journal of Industrial Ergonomics* 39 (2009) 121-126.

(Continued)

*Primary Examiner*—Milton Nelson, Jr.
(74) *Attorney, Agent, or Firm*—Clark & Brody

(57) ABSTRACT

A device is provided for supporting a portion of the upper body during forward lean. The device comprises a hinge joint provided on a base plate. A central pillar extends upwards from the hinge joint, the hinge joint enabling movement of the central pillar through a range of motions. A support plate is situated on the central pillar at an opposite end from the hinge joint, the support plate providing support to a user in the region of the user's breast plate. At least one resistor element is operably associated with the central pillar to receive stresses delivered via at least one linkage unit during periods of forward lean, thereby transferring at least a portion of the upper body weight to the at least one resistor element.

20 Claims, 10 Drawing Sheets

OTHER PUBLICATIONS

M. Abdoli-Eramaki, et al., "Comparison of 3D dynamic virtual model to link segment model for estimation of net L4/L5 reaction moments during lifting", *Computer Methods in Biomechanics and Biomedical Engineering* vol. 12, No. 2, Apr. 2009, 227-237.

M. Abdoli-Eramaki, et al., "Mathematical and empirical proof of principle for an on-body personal lift augmentation device (PLAD)", *Journal of Biomechanics* 40 (2007) 1694-1700.

C. Lotz, et al., "The effect of an on-body personal lift assist device (PLAD) on fatigue during a repetitive lifting task", *Journal of Electromyography and Kinesiology* 19 (2009) 331-340.

K. Kim, et al., "Modelling of shoulder and torso perception of effort in manual transfer tasks"*Ergonomics*, Jul. 15, 2004, vol. 47, No. 9, 927-944.

W. Keyserling, et al., "A checklist for evaluating ergonomic risk factors resulting from awkward postures of the legs, trunk and neck" *International Journal of Industrial Ergonomics*, 9 (1992) 283-301.

M. Abdoli-E, et al., "An on-body personal lift augmentation device (PLAD) reduces EMG amplitude of erector spinae during lifting tasks" *Clinical Biomechanics* 21 (2006) 456-465.

H. Frost, et al., "Responsiveness of a Patient Specific Outcome Measure Compared With the Oswestry Disability Index v2.1 and Roland and Morris Disability Questionnaire for Patients With Subacute and Chronic Low Back Pain", *SPINE* vol. 33, No. 22, pp. 2450-2457, 2008.

H. Johnson, et al., "Strength Capabilities and Subjective Limits in Repetitive Manual Exertions: Task and Hand Dominance Effects", *AIHA Journal* (64) Nov./Dec. 2003, pp. 763-770.

* cited by examiner

Fig.8
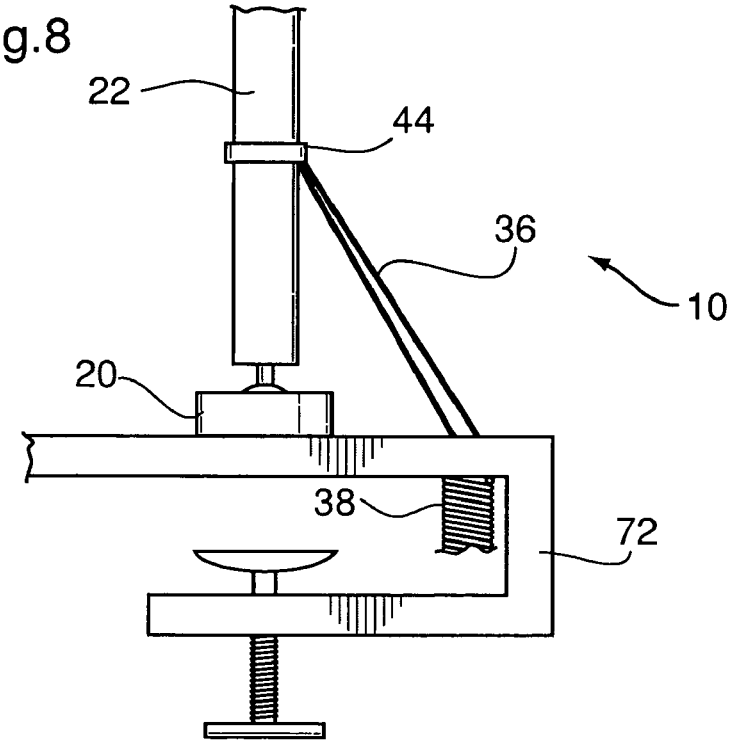
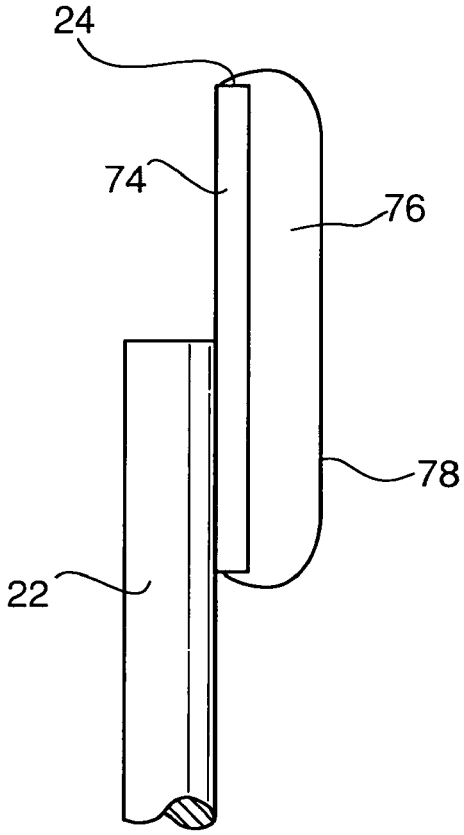
Fig.9A
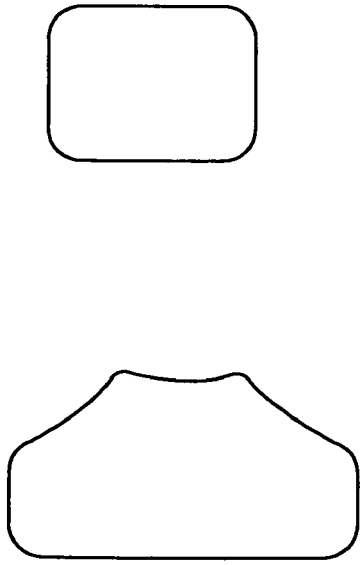
Fig.9B

DYNAMIC TRUNK SUPPORT SYSTEM

FIELD

The present invention pertains to back support systems, in particular to a dynamic back support system that provides back support during forward flexion through a three-dimensional range of motions.

BACKGROUND

Standing in a forward flexed position is an awkward posture due to the flexion extension moment created by the trunk as it bends forward away from the centerline. To hold this position the low back and hip extensor muscles must work continuously to counterbalance the moment composed of the weight of the upper body and external load, when applicable, times the length of the lever arm. Since the back extensors (erector spinae) work on a small lever arm an amplified tensile force is needed and as a result applies large compressive and shear forces through the lumbar spine. Stationary loading has been shown to increase the incidence of low back pain (Silverstein, Silverstein and Franklin, 1996), therefore lightening the biomechanical load on the lumbar spine should reduce the incidence of low back injuries. Once an injury has occurred, workers may be delayed in their return to work as they wait for sufficient healing and strengthening to take place so as their physical capacity matches the work demands.

Standing at work is a prevalent work posture (Tissot et al. 2005) but to date there are no effective assistive devices that lower the workload of the trunk muscles and reduce the compressive forces through the spinal joints (Swie and Sakamoto, 2004). In sitting, chair backrests have been shown to lower the muscular electromyography activity of the back extensors and abdominals (Makhsous, 2003) but this is not helpful when an individual leans forward to carryout a work task in front. An on-body personal lifting assist device (PLAD) has been shown to offset the spinal loads and reduces the electromyography of the erector spinae by 14%-21% and the compression and shear forces at L4/L5 by 13% to 15% (Abdoli et al. 2007, Lotz et al. 2007, Graham et al. 2008, Frost et al. 2008). PLAD is modeled on the concept of human muscle through the use of an elastic element that acts as an external muscle force generator but it has certain limitations associated with being an on-body device and appears best suited for dynamic work such as manual handling tasks with large vertical lifting. Alternate work postures include sitting or standing upright in a neutral position. Standing compared to sitting produces lower compressive forces through the lumbar spine (Callaghan & McGill, 2001), Psychophysically, however, the preference and perceived effort is mixed. Yates and Karwowski, (1992) found subjects perceived sitting to be harder and the authors attributed the difference to change in lumbar curvature. Kim et al., (2004) also found a higher perceived load in sitting but this was only for smaller subjects. Johnson and Nussbaum (2003), found that perceived effort was higher in a standing waist bend posture possibly due to more stability gained from leaning onto the fixture. An early study by Aaras et al. (1988) also showed that a seated posture was usually preferred despite increased load on the shoulder muscles and attributed to improved precision, stability, increased mobility and less load on legs and feet, less energy expenditure. Standing upright with the flexion extension moment neutral is ideal, however, this is not always possible and a forward flexed posture is needed when a work surface is below the elbow height or extreme reach beyond the length of the extended arm is needed. These two factors are unique to individuals and cannot always be accommodated by traditional ergonomic strategies.

Low back pain is the most common musculoskeletal complaint of workers with annual costs estimated at $12 Billion in 2002 in Canada (WorksafeBC, 2003) and $90 Billion in 1998 in the United States (Luo et al. 2004). Standing work has been identified as a risk factor for lower back pain as a result of the cumulative spinal loading and physiological work demands that result from the flexion moment that is created when the trunk leans forward from the upright neutral position. With as little as 10 degrees of forward lean the compressive loads through the lower lumber discs doubles (Takahashi et al., 2006). A recent population survey in Quebec showed that 58% of workers reported standing at work of which less than less 20% report that they can alternate position by sitting or walking (Tissot et al., 2005). Keyserling (1992), reported 89% of 335 surveyed manufacturing and warehouse jobs involved mild trunk flexion of less than 20 degrees. The degree of forward inclination depends upon individual anthropometry, design of workstation and nature of the work. The amount of forward leaning can be minimized by mechanical strategies that adjust workstation to fit the individual but this is not always practical, safe and can be costly.

An ergonomic device that safely lowers compressive loads may be effective in addressing the above-noted problems.

SUMMARY

According to an aspect of an embodiment, provided is a device for supporting a portion of the upper body during forward lean, the device comprising:

a hinge joint provided on a base plate;

a central pillar extending upwards from the hinge joint, the hinge joint enabling movement of the central pillar through a range of motions;

a support plate situated on the central pillar at an opposite end from the hinge joint, the support plate providing support to a user in the region of the user's breast plate;

at least one resistor element operably associated with the central pillar to receive stresses delivered via at least one linkage unit during periods of forward lean, thereby transferring at least a portion of the upper body weight to the at least one resistor element.

According to some embodiments, the hinge joint is a ball and socket joint.

According to some embodiments, said range of motions of said hinge joint includes up to 80° flexion-extension, up to ±70° lateral bend, up to ±70° rotation, and combinations thereof.

According to some embodiments, each at least one resistor element is associated with a corresponding linkage unit.

According to some embodiments, a plurality of resistor elements is provided, each resistor element being operably associated with a respective linkage unit.

According to some embodiments, the at least one resistor element is located below the base plate, opposite the side comprising the hinge joint, and wherein the linkage unit operably associates the resistor element to the central pillar.

According to some embodiments, the at least one resistor element undergoes compression during periods of forward lean to offset a portion of the upper body weight away from the user.

According to some embodiments, the at least one resistor element is adjustable to suit anthropometric differences and user preferences.

According to some embodiments, the at least one resistor element is a spring.

According to some embodiments, the spring is a coil spring.

According to some embodiments, the at least one resistor element is a hydraulic actuator.

According to some embodiments, the device further comprises height adjustability in the central pillar to enable height adjustments of the support plate.

According to some embodiments, the height adjustability of the central pillar is provided by way of a telescoping arrangement between a first support shaft, and a second support shaft.

According to some embodiments, the device further comprises a springed telescoping element to provide length variability in the central pillar to allow for a degree of length variability during usage.

According to some embodiments, the springed telescoping element provides up to approximately 10 cm of length variability.

According to some embodiments, the device further comprises a pelvic support pad located on the base plate to enabling a user's hips to lean up against the device.

According to some embodiments, the pelvic support pad is pivotable through a range of motions of up to ±20°.

According to some embodiments, the device further comprises a clamp mechanism to allow for attachment of the device to a table top.

According to some embodiments, the central pillar extends below the base plate, terminating at a support platform upon which a user may stand, enabling the device to be used as a stand-alone unit.

According to some embodiments, the central pillar below the base plate is height adjustable.

According to some embodiments, the device is configured for attachment to a chair allowing for support during a forward lean sitting position.

BRIEF DESCRIPTION OF THE DRAWINGS

Embodiments will now be described, by way of example only, with reference to the attached Figures, wherein:

FIG. 8 is a side view of the DTS device, showing a clamp mechanism for table-top mount;

FIG. 9A is a side sectional view of the support plate;

FIG. 9B is a schematic representation of suitable support plate shapes;

DESCRIPTION OF ILLUSTRATIVE EMBODIMENTS

The dynamic trunk support (DTS) device is a mechanical device that reduces biomechanical loading and physiological work of the lower back by continuously supporting the trunk during forward leaning. It has been determined that supporting a portion of the upper body weight reduces the flexion moment thus reducing the muscular work necessary to counterbalance the moment and resulting spinal load. The device is intended to reduce the incidence of lower back injury, promote an early return to work following a lower back injury and increase stability in standing. The DTS device described herein is designed to support a portion of the body weight through the bony ribcage while allowing full axial movement.

Figure 1A:
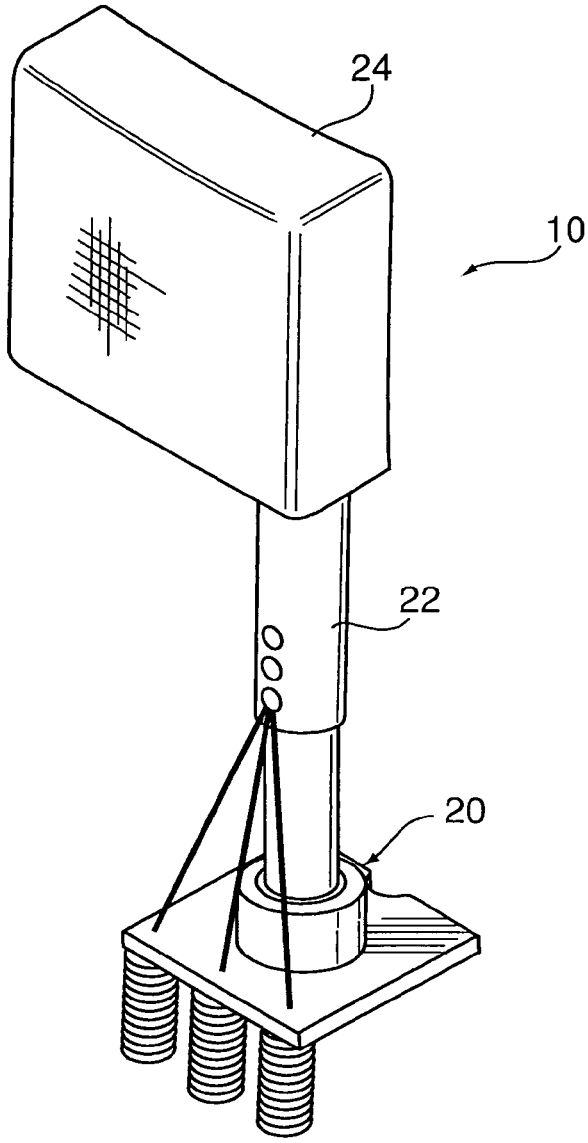
FIG. 1A is a perspective view of the DTS device.
Figure 1B:
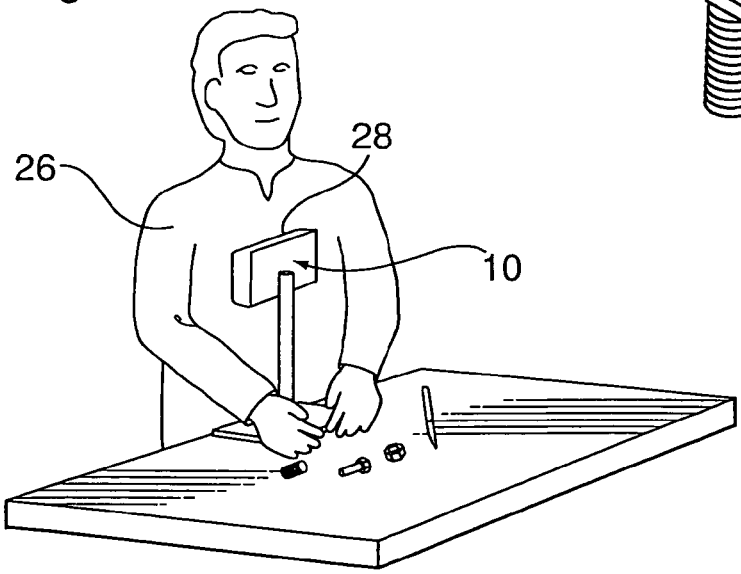
FIG. 1B is a perspective view of the DTS device mounted to a table, shown with a user.

Turning now to FIG. 1A, shown is an embodiment of the Dynamic trunk support (DTS) device 10. The DTS device generally comprises a hinge joint 20, a central pillar 22 extending upwards from the hinge joint 20 and a support plate 24 positioned on the central pillar 22, opposite the hinge joint 20. As will be described in greater detail below, a user 26 of the DTS device 10 will generally stand or sit behind the device 10 as shown in FIG. 1B, wherein the support plate 24 is configured to align to the user at the level of the bony ribcage 28.

Figure 2:
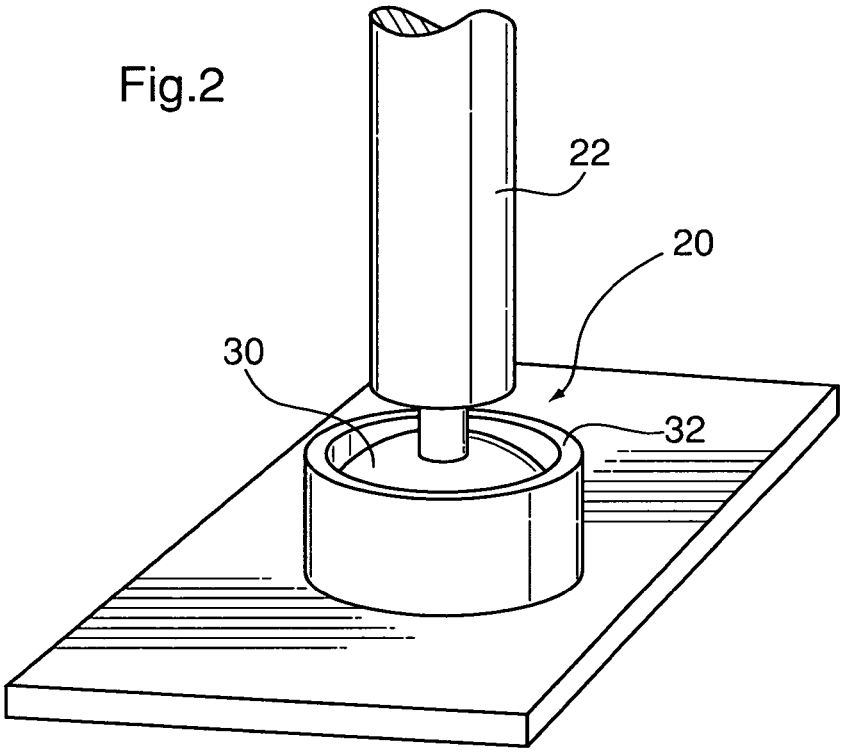
FIG. 2 is a perspective view of the hinge joint of the DTS device.

Shown in FIG. 2 is the hinge joint 20 of the present embodiment. As shown, the hinge joint is a ball and socket joint (or ball joint) comprising a spherical knob 30 positioned at the end of the central pillar 22, the knob 30 fitting securely into a mating hemispherical socket 32 provided on a base plate 34. The use of a ball joint for this application permits relative angular motion in nearly all directions, thereby preventing unnecessary restriction of movement during use of the device. Exemplary limits of extension are as follows:

flexion-extension 80°
lateral bends ±70°, and
rotation ±70°.

In use, the actual range of motions the DTS device will be subject to will be generally dictated by the particular application.

Figure 3:
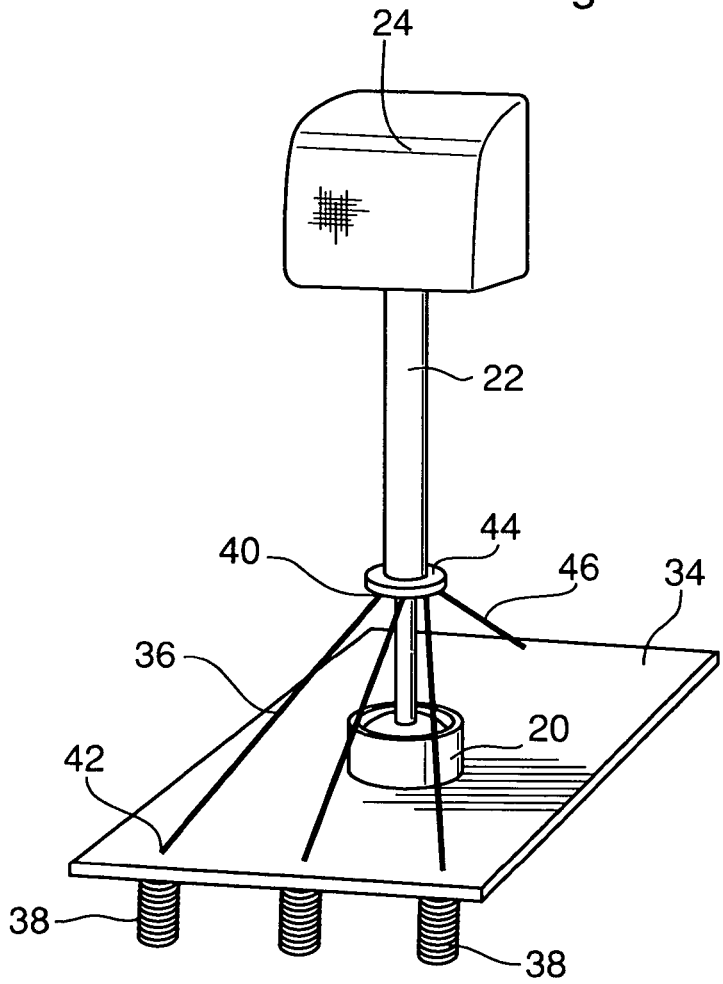
FIG. 3 is a perspective view of the DTS device showing the linkage units.

Referring now to FIG. 3, to support the body during forward lean, the central pillar 22 is supported by a plurality of linkages 36 attached to corresponding resistor elements 38. In one embodiment, the resistor elements 38 are provided as coil springs, but other types of springs or resistor elements in general may be used as would be apparent to one skilled in the art. For example, hydraulic actuators such as those found on ergonomic chairs may be used. In the embodiment shown, the resistor elements 38 are provided below the base plate 34. The combination of a linkage 36 and a corresponding resistor element 38 is collectively referred to herein as a linkage unit. The linkage 36 of each respective linkage unit is affixed on a first end 40 to the central pillar 22, with forward lean upon the central pillar 22 imparting a given amount of compressive stress upon the resistor elements 38 operably associated with a second end 42 of the linkage 36. In the embodiment shown, three linkage units are provided, a first central linkage unit, and two side linkage units placed symmetrically about the central linkage unit. While represented as three linkage units, generally a plurality of linkage units can be used, that is any number of linkage units ranging from at least two, with the arrangement of the linkage units generally being symmetrical about the central pillar 22. For example, the plurality of linkage units may be arranged in the form of a linear or semicircular array, comprising 10 or more individual linkage units. To attach the first end 40 of the linkage 36 to the central pillar 22, a variety of fastening mechanisms may be implemented. For example, the central pillar 22 may be provided with a circumferential collar 44 that is configured with suitable fasteners that releasably retain the first end 40 of the linkage 36. Alternatively, the linkages 36 may be affixed directly to the central pillar 22 using suitable fasteners or engagement anchors.

The resistor elements 38 can be adjustable to suit anthropometric differences as well as user preference. The resistor elements can be independently adjustable, or alternatively adjustable as a complete unit. In the case of springs, the springs themselves can be interchanged to suit a particular user. In the case of hydrautic actuators, built in adjustments can be used to alter their compression characteristics.

The extent of compression of each of the resistor elements 38 is dependent upon the extent of lean, and the direction of lean relative to the neutral position. As one will appreciate, in a forward lean directed towards the right-hand side, compressive stresses are delivered via the linkage units to the central and side resistor elements 38 on the left-hand side of the device 10, and visa versa. Motion of the central pillar 22 through the allowable range of forward lean has the effect of dynamically transferring to the resistor elements 38 a portion of the upper body weight. Support of the upper body is accomplished by way of redirecting the load through the DTS into the linkage units, in particular the resistor elements 38 in the form of compressive stresses, thereby supporting the forward lean throughout.

In addition to the plurality of linkage units provided, at least one further restraint linkage 46 can be provided on the side opposite the linkage units to prevent the central pillar 22 from falling towards the user when the user backs away from the DTS device 10. The restraint linkage 46 is not intended to support any loads. As such, it is not necessary to provide the restraint linkage 46 with a resistor element 38 as detailed above for the other linkage units.

Figure 4A:
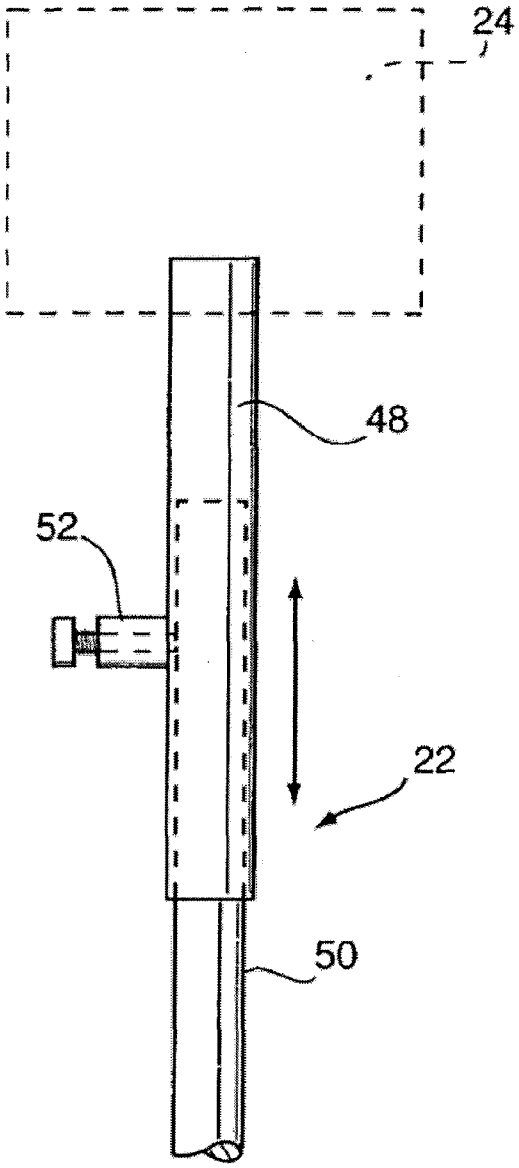
FIG. 4A is a sectional view of one embodiment of the telescoping feature of the central pillar.
Figure 4B:
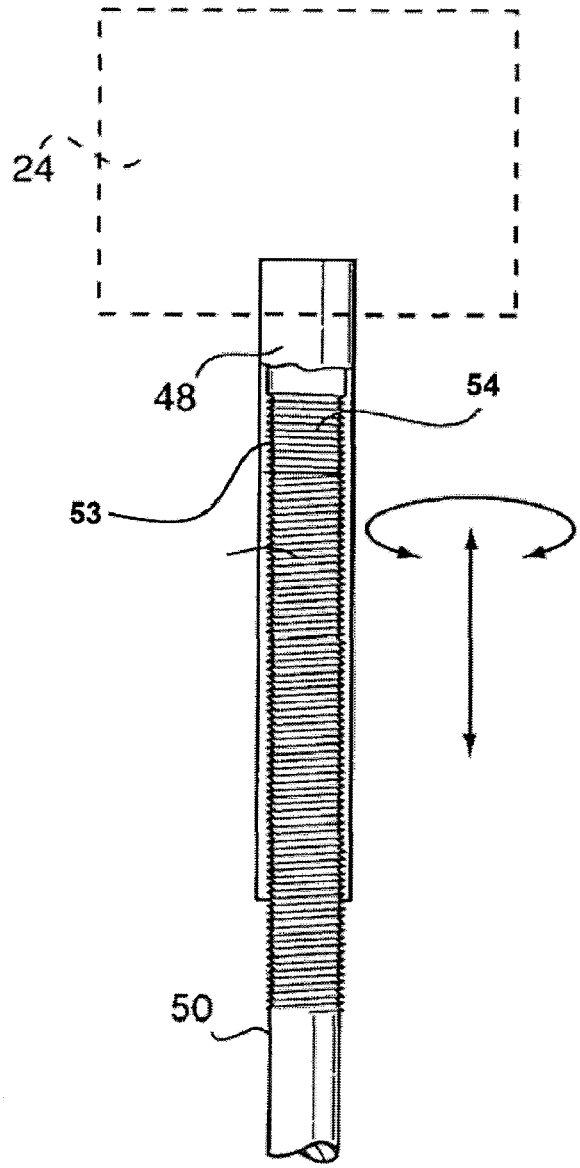
FIG. 4B is a sectional view of another embodiment of the telescoping feature of the central pillar.

To accommodate different users, the height of the support plate 24 can be adjustable. Optimal placement upon a user is generally 2 cm below the sternal notch. For this adjustability, as shown in FIG. 4A, the central pillar 22 is provided as a telescoping shaft, comprising a first support shaft 48 on which the support plate 24 is mounted, and a second support shaft 50 upon which the first support shaft 48 is slidable in a telescoping arrangement. As shown, the first support shaft 48 is configured with an internal diameter that is greater than the outside diameter of the second support shaft 50, thereby allowing the first support shaft 48 to telescope over the second support shaft 50. As one will appreciate, the opposite arrangement is also possible whereby the diameters of the first and second support shafts are such that the first support shaft 48 is configured to telescope within the second support shaft 50. To set the telescoping support shaft at a particular height, a locking mechanism 52 is provided. For example, a quick adjust mechanism such as a spring-biased pin for cooperating with a plurality of holes in at least one of the shafts can be provided. Alternatively, a set screw mechanism can be provided to set a particular height. Locking mechanisms suitable for locking the telescoping support shafts relative to one another are known in the art. In a further embodiment, as shown in FIG. 4B, the height of the support plate 24 is governed by a threaded engagement between the first 48 and second 50 support shafts. In such an arrangement, the first 48 and second 50 support shafts are provided with respective cooperating threads 53, 54. Rotation of the first support shaft 48 relative to the second support shaft 50 has the effect of lengthening or shortening the central pillar 22, effectively raising or lowering the support plate 24. Further alternate arrangements for adjusting the height of the support plate 24 may be used and are generally known, for example in the art of ergonomic chairs and the like.

Figure 5:
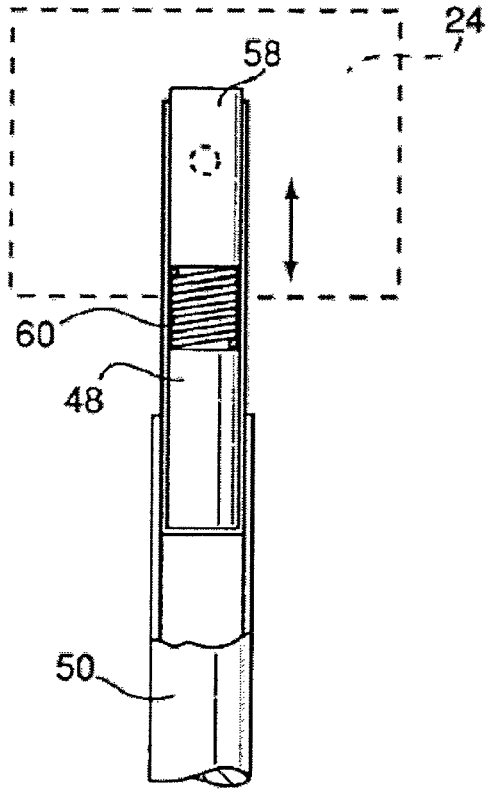
FIG. 5 is a sectional view of the springed telescoping element for length variation in the central pillar.

In some embodiments, during forward lean and movement through the range of motions allowable with the DTS device 10, the height of the support plate 24, in particular the distance between the hinge joint 20 and the support plate 24 allows for a degree of length variability. In the absence of this variability, that is with a central pillar 22 of fixed length, the support plate 24 is apt to shift upon the user's chest, causing discomfort over extended periods of use. As such, the DTS device 10 can be provided with a mechanism that can accommodate a range of length variability, while not substantially departing from the predefined height as previously established. To accomplish this, the central pillar 22 can be provided with a springed telescoping element that can compress or extend in the range of 1 to 10 cm to accommodate the aforementioned variations in length during usage. The springed telescoping element may be integrated into the aforementioned locking mechanism, or may be provided as a separate element on the central pillar 22. For example, as shown in FIG. 5, the support plate 24 may be provided on a third support shaft 58 that can telescope relative to the first support shaft 48. The movement of the third support shaft 58 relative to the first support shaft 48 may be generally fixed by way of a spring 60 that allows for limited movement of the third support shaft 58 through a range of 1 to 10 cm in either direction relative to neutral.

Figure 6A:
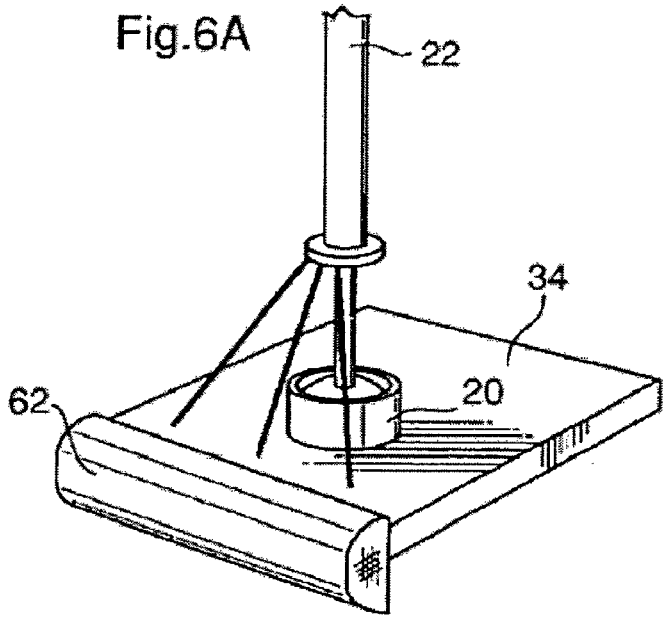
FIG. 6A is a perspective view showing use of an optional pelvic support pad.
Figure 6B:
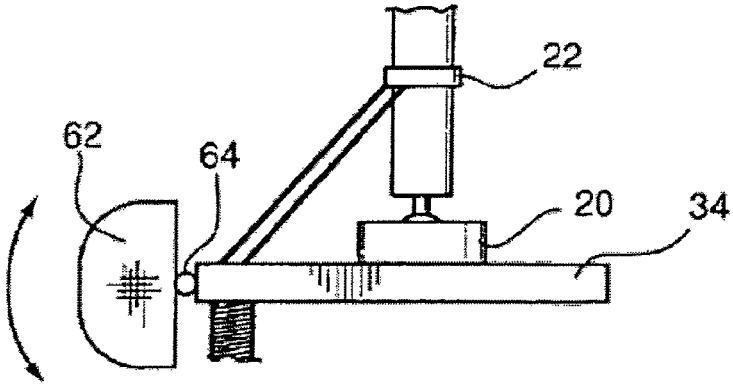
FIG. 6B is a side view of the DTS device, further detailing the optional pelvic support pad.

The base plate 34 is generally located at the height of the pelvic bone. To support the user in a forward lean configuration, and to provide added comfort during use, a pelvic support pad 62 is can be provided, as shown in FIG. 6A. The pelvic support pad 62 can be attached directly to the base plate 34 in a non-adjustable fixed configuration. Alternatively, the pelvic support pad 62 can be mounted using a suitable hinge 64 (see FIG. 6B) that permits a limited range of tilt (+/−20°) during usage. A tiltable pelvic support pad 62 can be further provided with a lock mechanism to releasably fix the pelvic support pad 62 at a given angle as chosen by a user. For example, a suitable lock mechanism may comprise a quick release lever mechanism as commonly found on ergonomic chairs. In some embodiments, the pelvic support pad may also be height adjustable to permit a customized fit to a specific user.

Figure 7:
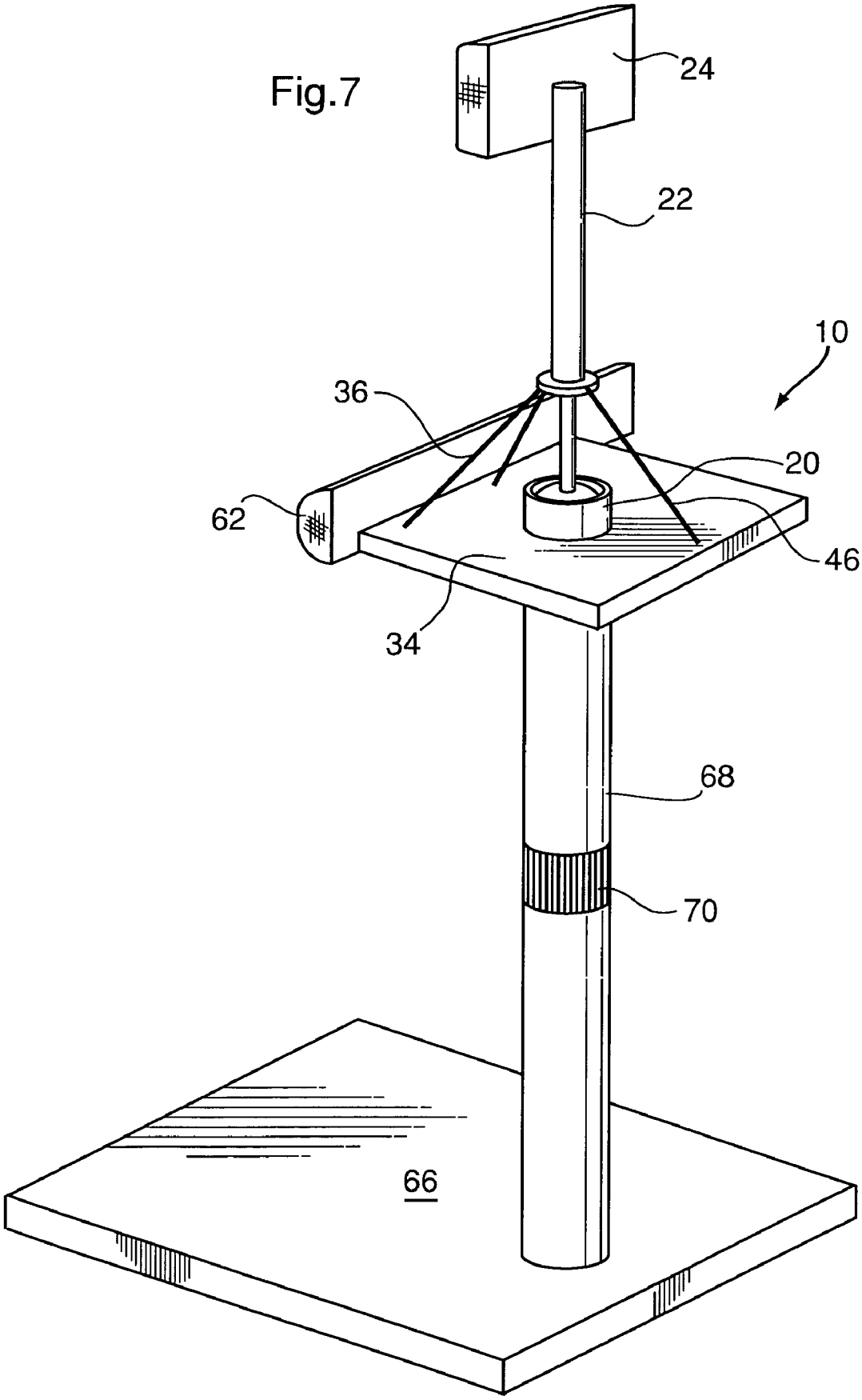
FIG. 7 is a perspective view of a stand-alone configuration of the DTS device.
Figure 10A:
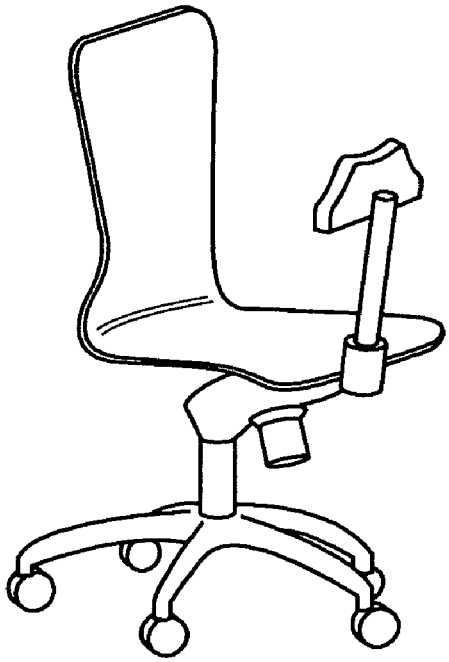
FIGS. 10A through 10D show a fold-away DTS device.
Figure 10B:
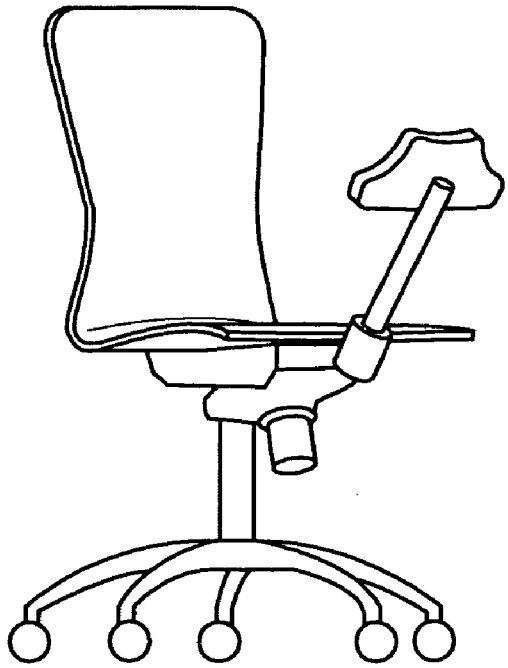
Figure 10C:
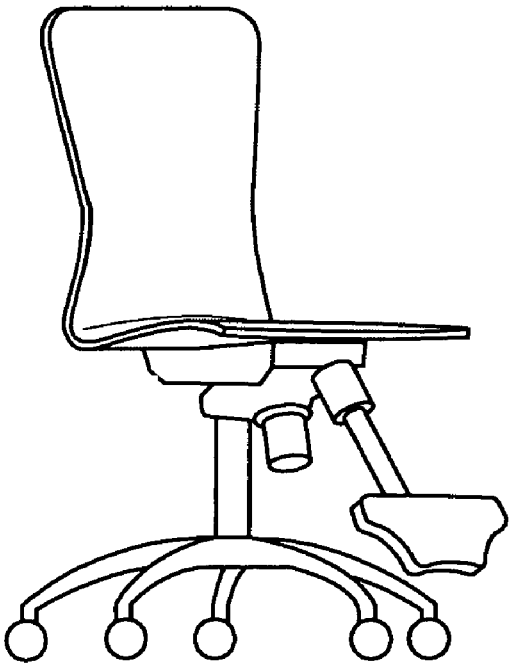
Figure 10D:
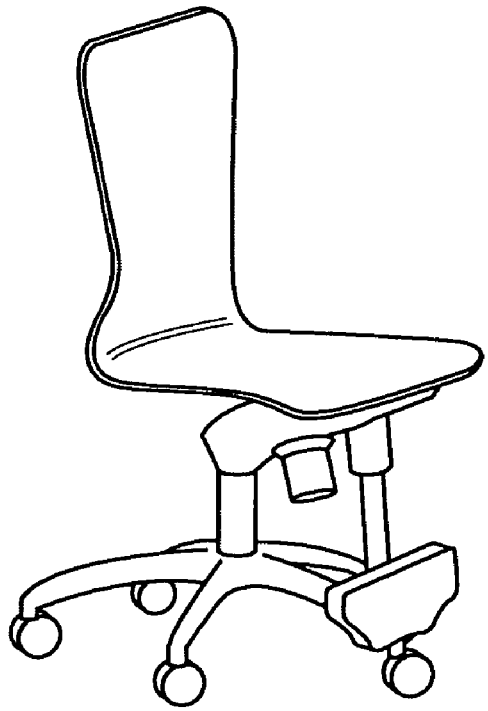

The DTS device 10 is suitable for use as a stand-alone device, or in combination with a table top. An exemplary stand-alone device is shown in FIG. 7 wherein the central pillar 22 extends below the base plate 34, terminating at a support platform 66 upon which the user stands. To accommodate users of different height, the lower central pillar 68 can be provided with a height adjuster 70. Height adjustability can be provided any number of ways as would be apparent to one skilled in the art. For example, height adjustability may be provided through the use of telescoping members similar to that described above with respect to the upper central pillar 22. Alternate height adjustability mechanisms are generally known in the art of ergonomic chairs and the like, and would be known to one skilled in the art. To facilitate transport of a stand-alone device, for example where used in environments where the user must move from one location to another, the support platform may be provided with wheels. The wheels are configured to retract or are otherwise arranged for usage only during movement of the device, such as when the stand-alone device is tilted for movement from one location to another.

For a DTS device 10 suitable for use in combination with a table top, the device 10 is provided with a clamp mechanism 72 such as the one shown in FIG. 8. A variety of clamp mechanisms can be used, such as those based on C-clamp or toggle clamp configurations. Other suitable clamping mechanisms would be apparent to one skilled in the art.

A combination table top/stand alone configuration is also possible. For example, the base plate 34 can be configured for interchangeable attachment to either the clamp mechanism as shown in FIG. 8, or the stand alone configuration shown in FIG. 7.

The support plate 24 and optional pelvic support pad 62 is constructed using materials generally known in the art of chair manufacture. In general, as shown in FIG. 9A, the support plate 24 is comprised of a metal, plastic or composite base 74 for secure attachment to the central pillar 22. The base 74 is then provided with at least one layer of suitable padding, such as foam 76, over which a suitable material 78 (e.g. fabric, plasticized fabric, vinyl, etc.) is placed. The support plate 24 is relatively small and generally shaped to optimally distribute the body weight forces over an anatomically appropriate area of the bony ribcage. The support plate 24 is sized to allow freedom of movement of the shoulder girdle and upper extremities, as well as avoiding compression of the soft tissue of the abdomen, and female breasts. Exemplary shapes for the support plate are shown in FIG. 9B.

The concept of supporting the trunk in forward lean can also be applied to sitting work where the leaning forward position still creates a flexion moment that the erector spinae must work to balance. Sitting has been shown to have higher compressive disc loads. Shown in FIGS. 10A through 10D is a chair, in particular an ergonomic chair having a fold-away DTS device attached thereto. The DTS device is either configured to attach to a standard chair by way of a suitable clamp mechanism, or alternately is incorporated into the design of the chair itself. Much like the embodiment discussed above, the design shown comprises a support plate 24 provided on a central pillar 22, such as a height-adjustable central pillar which in turn is attached to the hinge joint 20. To ensure comfort to the user, the base plate 34 and associated linkage unit components are maintained under the seat of the chair.

It may also be advantageous to configure the stand-alone or table-top versions of the DTS device with a fold-away or retractability feature. In particular, in the event the DTS device presents an obstruction or impediment to work when forward leaning is not necessary, the ability to retract or fold-away the device would be desirable.

In use, the DTS device can provide (1) continuous partial support through a range of motion, (2) three dimensional trunk movement, (3) load transfer over the most stable part of the anterior rib cage, (4) no interference with arm mobility, (5) no compression in the thoracic outlet area.

Figure 11:
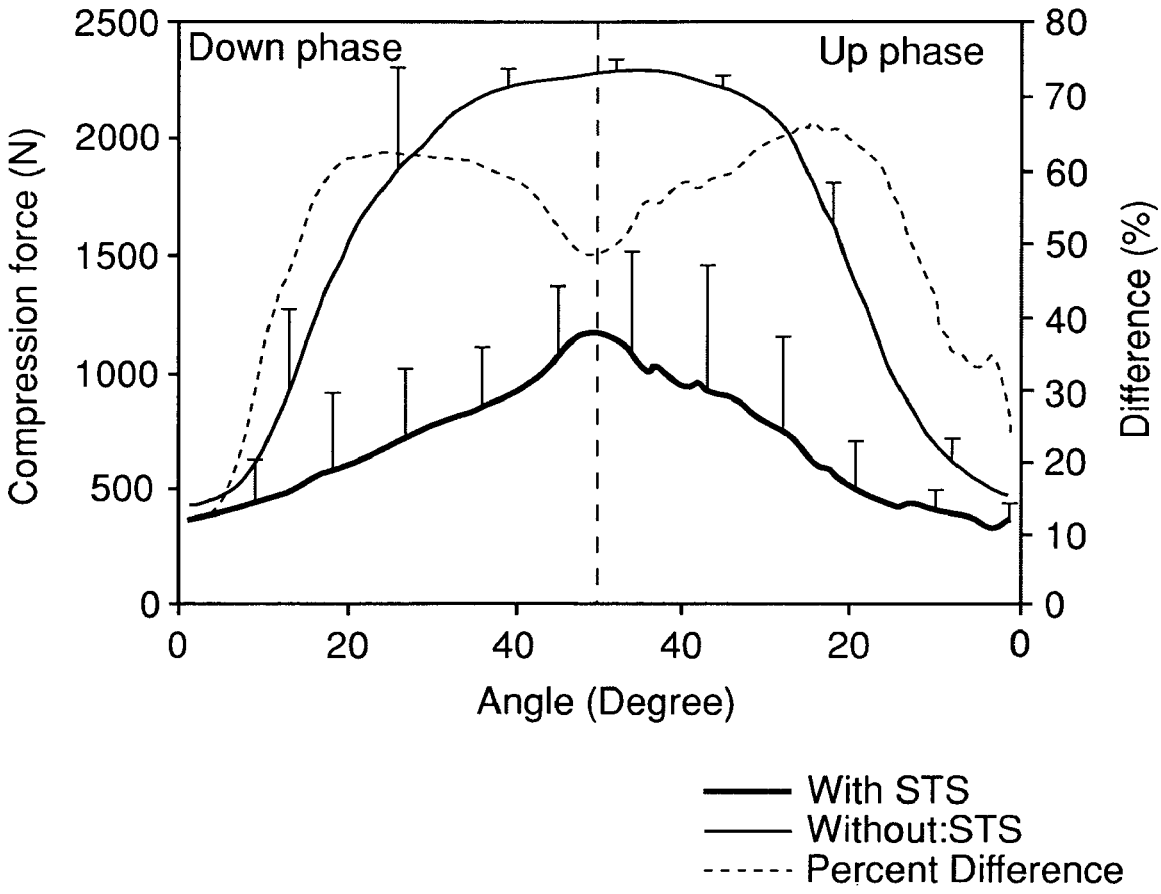
FIG. 11 is a graph showing percent difference of lumbar compression force with and without the DTS device.
Figure 12:
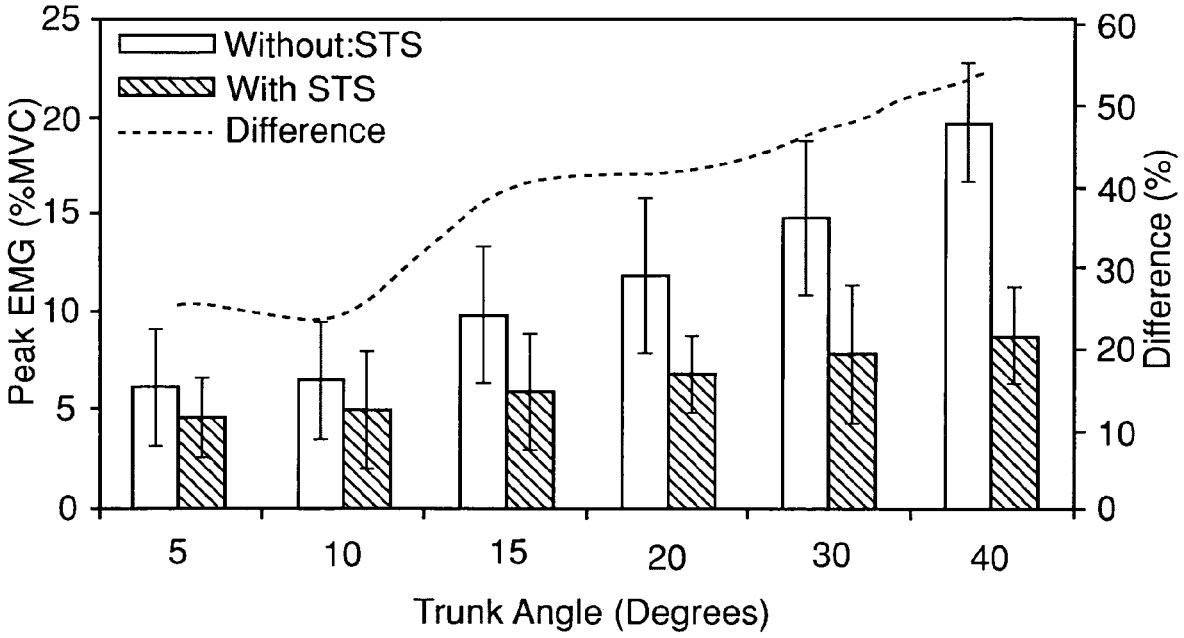
FIG. 12 is a graph showing percent difference of peak EMG with and without the DTS device.

In one study that analyzed single plane forward flexion through a trunk angle of 0 to 50°, the DTS device was able to reduce the compression forces at the L4-L5 joint between 10 to 70% at 10 and 50 degrees respectively (see FIG. 11). In a further study, analyzing single plane forward flexion through a trunk angle of 0 to 40°, the DTS device was able to reduce peak EMG (L4-L5 joint) between 5 to 55% at 10 to 40 degrees respectively (see FIG. 12)

Figure 13:
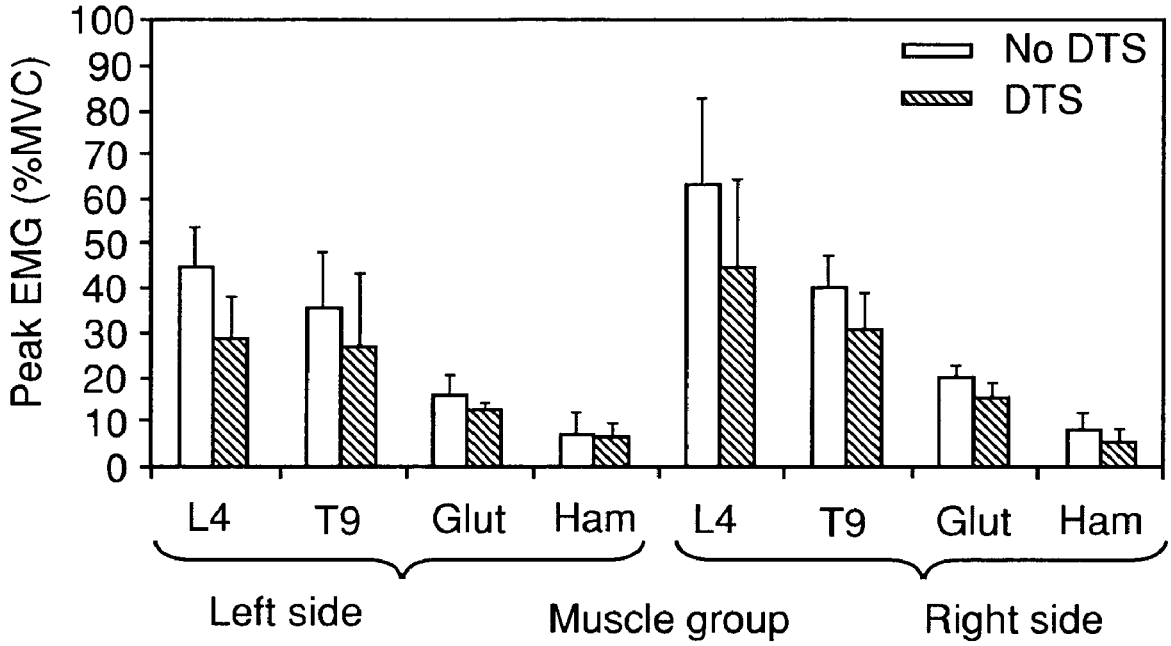
FIG. 13 is a graph showing percent difference of peak EMG with and without the DTS device during asymmetrical activity.

The impact of the DTS device upon asymmetrical postures, spinal loading, trunk muscle activity, reach distance, comfort and perceived effort with dynamic trunk movement was assessed. FIG. 13 presents further exemplary data showing a reduction in peak EMG during usage of the DTS device. In this test, 10 female subjects lifted a 4.71 Kg mass from a central location on the table top (positioned at 10 cm below elbow height) and place it at 130% of horizontal reach distance in approximately 45 degrees diagonally across the body and away from the body for two conditions; with and without leaning through the DTS. Three repetitions for each reach was completed, all at a comfortable pace of 5 cycles per minute using an electronic metronome. The peak EMG of both left and right hand erector spine muscles at L4/L5 and T9 levels as well as the Gluteus maximus and Hamstring muscles were compared during this activity. As FIG. 13 shows, average peak EMG amplitude reductions were common across all subjects and reduced the amplitudes of contralateral muscles by 37% for lower erector spinae, 25% for thoracic erector spainae, 22% for Gluteus and 34% for hamstring muscles. As these postural muscles are the dominant contributor to compressive loading on the lumbar, hip and knee joints, these were substantial reductions in demand.

The DTS device may find application in a range of areas, including (1) industry, healthcare and the service sector, (2) orthopaedic rehabilitation, and (3) home support for the disabled and elderly.

The DTS device may also be used as a prescriptive clinical work brace for orthopaedic rehabilitation for injured workers with lower back injuries. It could be used in workplaces to facilitate a safe return to work following a significant low back injury such as disc protrusion, spinal fracture or instability. Further, the DTS device could be a prescriptive leaning device for elderly individuals at home who experience problems with balance and/or generalized weakness. It could be used as a postural support while carrying out activities of daily living, for example while brushing teeth or combing hair.

The DTS device may be marketed as a preventative ergonomic device for use in the workplace, particularly in the manufacturing, healthcare and the service sector where a significant portion of work is carried out in forward leaning trunk postures. The device reduces a worker's exposure to compressive and shear forces through the lumbar spine that eventually translate into lower back discomfort, productivity loss and injury claims. Other benefits from the use of the DTS device include increased core stability with an off balancing reach, reduction in the physiological cost of work resulting from lessened postural muscular workload, promotion of a suitable spinal posture rather than a forward slump, and limitation of rotational movements during forward flex.

The DTS may be used as a clinical assistive device used in the early postoperative stage following a lower back injury and/or surgery or at a later recovery stage to protect bones and joints from compressive and shear joint forces and contractile soft tissue from excessive muscular tension following repair of a spinal fracture or disc protrusion. The DTS device could be adapted to provide an adjustable level of support that can be changed according to the stage of healing and tissue tolerance and adjustable limits for range of motion in three dimensions. For example, a surgeon could prescribe maximum of 30 degrees forward flexed trunk with no rotation and 80% support. In the later stage of recovery, typical functional restoration programs are directed to progressively increase tissue loading until there is adequate tolerance and reduced fear of pain or re-injury. The DTS device may serve as an adjunct to existing rehabilitation interventions. The DTS device may promote an earlier return to pre injury or modified work by simply lowering the spinal loads and muscular workload of the job and reducing the likelihood of an early onset of local back muscle fatigue.

The DTS device may also be used to assist seniors with diminished balance, generalized weakness, or shortened reach distance. Walking aids used for balance require the use of both hands and therefore are not available to carry out simple tasks. Given the DTS device does not limit arm use, it could be used as a postural support while carrying out activities of daily living, such as brushing teeth or combing hair.

Postural supports are generally rigid in nature and can impede normal work movement patterns and be uncomfortable to wear or use. The DTS device is based on a biomechanical principle using leverage and support to lower physiological demands. It is based on dynamic splinting providing partial support, thereby limiting the risk that the spinal joints and discs are kept in a static position. Physiological movement is active assisted thereby preventing muscle atrophy from disuse and work specific deconditioning.

It will be appreciated that, although embodiments have been described and illustrated in detail, various modifications and changes may be made. While several embodiments are described above, some of the features described above can be modified, replaced or even omitted. For example, while the hinge joint is described as a ball and socket joint, other joint mechanisms providing the range of angular motions may be possible, for example a universal joint. The DTS device can also be modified to include a lubrication mechanism to reduce friction in the joint. Still further alternatives and modifications may occur to those skilled in the art. All such alternatives and modifications are believed to be within the scope of the invention and are covered by the claims appended hereto.

The invention claimed is:

1. A device for supporting a portion of an upper body during forward lean, said device comprising:

a hinge joint provided on a base plate;

a central pillar extending upwards from said hinge joint, said hinge joint enabling movement of said central pillar through a range of motions;

a support plate situated on said central pillar at an opposite end from said hinge joint, said support plate providing support to a user in the region of the user's breast plate;

at least one resistor element is adjustable to suit anthropometric differences and user preferences, the at least one resistor element is operably associated with said central pillar to receive stresses delivered via at least one linkage unit during periods of forward lean, thereby transferring at least a portion of the upper body weight to the at least one resistor element.

2. The device according to claim 1, wherein said hinge joint is a ball and socket joint.

3. The device according to claim 1, wherein said range of motions of said hinge joint includes up to 80° flexion-extension, up to ±70° lateral bend, up to ±70° rotation, and combinations thereof.

4. The device according to claim 1, wherein each at least one resistor element is associated with a corresponding linkage unit.

5. The device according to claim 1, wherein a plurality of resistor elements is provided, each resistor element being operably associated with a respective linkage unit.

6. The device according to claim 1, wherein said at least one resistor element is located below the base plate, opposite the side comprising the hinge joint, and wherein the linkage unit operably associates the resistor element to the central pillar.

7. The device according to claim 1, wherein said at least one resistor element undergoes compression during periods of forward lean to offset a portion of the upper body weight away from the user.

8. The device according to claim 1, further comprising a clamp mechanism to allow for attachment of the device to a table top.

9. The device according to claim 1, wherein the at least one resistor element is a spring.

10. The device according to claim 9, wherein the spring is a coil spring.

11. The device according to claim 1, wherein the at least one resistor element is a hydraulic actuator.

12. The device according to claim 1, further comprising a pelvic support pad located on the base plate to enabling a user's hips to lean up against the device.

13. The device according to claim 12, wherein the pelvic support pad is pivotable through a range of motions of up to ±20°.

14. The device according to claim 1, further comprising a springed telescoping element to provide length variability in the central pillar to allow for a degree of length variability during usage.

15. The device according to claim 14, wherein the springed telescoping element provides up to approximately 10 cm of length variability.

16. A device for supporting a portion of an upper body during forward lean, said device comprising:

a hinge joint provided on a base plate;

a central pillar extending upwards from said hinge joint, said hinge joint enabling movement of said central pillar through a range of motions;

a support plate situated on said central pillar at an opposite end from said hinge joint, said support plate providing support to a user in the region of the user's breast plate;

at least one resistor element operably associated with said central pillar to receive stresses delivered via at least one linkage unit during periods of forward lean, thereby transferring at least a portion of the upper body weight to the at least one resistor element;

wherein said at least one resistor element is a spring.

17. The device of claim 16, wherein said hinge joint is a ball and socket joint.

18. The device of claim 16, wherein said range of motions of said hinge joint includes up to 80° flexion-extension, up to ±70° lateral bend, up to ±70° rotation, and combinations thereof.

19. The device of claim 16, wherein each at least one resistor element is associated with a corresponding linkage unit.

20. A device for supporting a portion of an upper body during forward lean, said device comprising:

a hinge joint provided on a base plate;

a central pillar extending upwards from said hinge joint, said hinge joint enabling movement of said central pillar through a range of motions;

a support plate situated on said central pillar at an opposite end from said hinge joint, said support plate providing support to a user in the region of the user's breast plate;

at least one resistor element operably associated with said central pillar to receive stresses delivered via at least one linkage unit during periods of forward lean, thereby transferring at least a portion of the upper body weight to the at least one resistor element;

wherein said at least one resistor element is a hydraulic actuator.

* * * * *